US005732819A

United States Patent [19]

Nishimura et al.

[11] Patent Number: 5,732,819

[45] Date of Patent: Mar. 31, 1998

[54] GOLF BAG

[75] Inventors: Toshinori Nishimura; Tatsuo Nishimoto, both of Hiratsuka, Japan

[73] Assignee: The Yokohama Rubber Co., Ltd., Tokyo, Japan

[21] Appl. No.: 684,888

[22] Filed: Jul. 25, 1996

[30] Foreign Application Priority Data

Jul. 27, 1995 [JP] Japan ..... 7-192037

[51] Int. Cl.[6] ..... A63B 55/00

[52] U.S. Cl. ..... 206/315.3; 206/315.6

[58] Field of Search ..... 206/315.2–315.8

[56] References Cited

U.S. PATENT DOCUMENTS

| | | | |
|---|---|---|---|
| 1,780,802 | 11/1930 | Sutcliffe | 206/315.6 |
| 2,064,542 | 12/1936 | Jones | 206/315.6 X |
| 3,674,072 | 7/1972 | Shuto | 206/315.6 |
| 3,729,036 | 4/1973 | McFadden | 206/315.6 |
| 4,227,559 | 10/1980 | Stroman | 206/315.2 X |
| 4,509,643 | 4/1985 | Rhee | 206/315.8 |
| 4,881,638 | 11/1989 | Cho | 206/315.6 X |
| 5,123,531 | 6/1992 | Beretta | 206/315.3 |
| 5,501,328 | 3/1996 | Keller et al. | 206/315.4 X |

FOREIGN PATENT DOCUMENTS

| | | | |
|---|---|---|---|
| 2256808 | 12/1992 | United Kingdom | 206/315.6 |

*Primary Examiner*—Sue A. Weaver

*Attorney, Agent, or Firm*—Finnegan, Henderson, Farabow, Garrett & Dunner

[57] ABSTRACT

A golf bag is provided at least on an upper region of an inner surface of a bag body with a member for guiding a shaft of a golf club when the golf club is drawn out of and inserted into the bag body.

3 Claims, 2 Drawing Sheets

GOLF BAG

BACKGROUND OF THE INVENTION

This invention relates to a golf bag used to hold golf clubs therein (a bag holding golf clubs therein and carried by a caddie for a golfer round the course-caddie bag), and more particularly to a golf bag adapted to take golf clubs out of and into (draw and insert golf clubs out of and into) the same easily.

When especially, an elongated, small-weight wood golf club out of a plurality of golf clubs held in a conventional golf bag is drawn out of and inserted into the same bag, a grip portion having a high frictional resistance of such a golf club is caught on an upper region of an inner surface of the golf bag in some cases to prevent the golf club from being put out of and into the bag smoothly.

When the golf club thus caught on the inner surface of a golf bag is pushed forcibly into the bag, a bending force, which causes a shaft portion of the golf club to be deformed greatly, and compressive stress are exerted on the shaft portion, and the shaft portion is broken in the worst case.

Even when the shaft portion is not broken, the lifetime thereof is shortened due to a bending force, which would cause the shaft portion to be deformed greatly, and compressive stress exerted thereon.

The golf bags which have heretofore been proposed include a golf bag provided with a cushion member on an inner surface of an insert port thereof for golf clubs (Japanese Patent Application Kokai Publication No. 58-188475), and a golf bag provided with a fixing means for preventing golf club shafts from being moved on an inner surface thereof (Japanese Patent Application Kokai Publication No. 58-177676). However, a golf bag formed so that a golf club is drawn out of and inserted into the same smoothly has not yet been proposed.

SUMMARY OF THE INVENTION

An object of the present invention is to provide a golf bag capable of drawing and inserting a golf club out of and into the same smoothly.

To achieve this object, the present invention provides a golf bag, wherein a bag body has an insert port at an upper portion thereof, and a reception bottom at a lower portion thereof, characterized in that at least an upper region of an inner surface of the bag body is provided with a member for guiding a golf club shaft when a golf club is pulled out of or put into the bag body.

Since a member for guiding a golf club shaft is thus provided on at least an upper region of an inner surface of a bag body of a golf bag, a body or a grip portion of a golf club can be slid smoothly via the guide member when a golf club is drawn out of or inserted into the golf bag. Accordingly, a club shaft is not caught on the inner surface of a golf bag, and this enables the breakage and deformation of a golf club shaft to be prevented, and the lifetime of a golf club to be prolonged.

DESCRIPTION OF THE PREFERRED EMBODIMENTS

Figure 1:
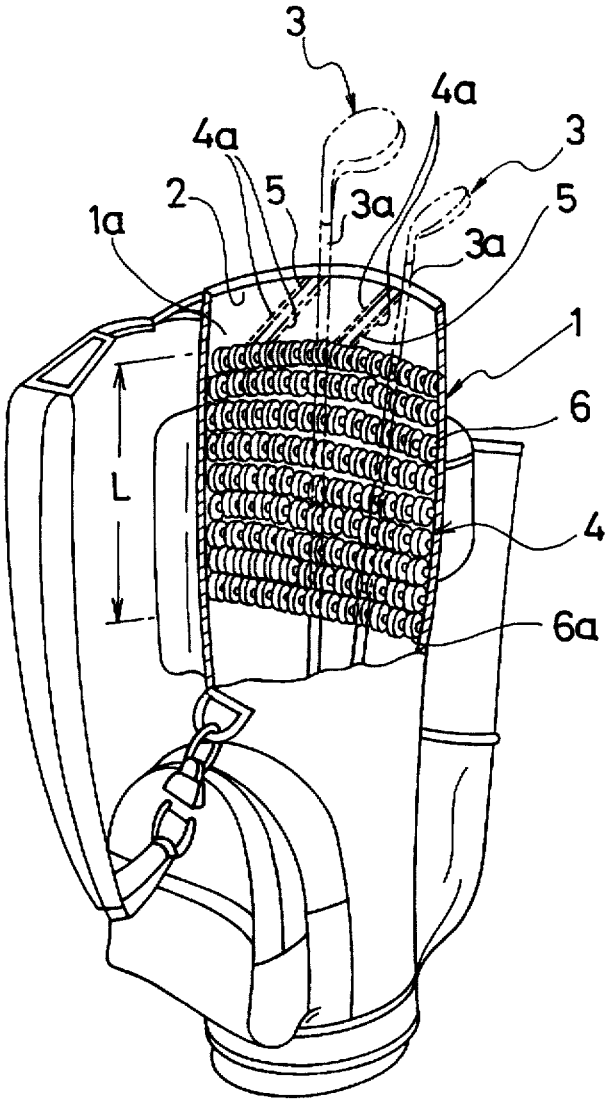
FIG. 1 is a partially cutaway view in perspective of an example of the golf bag according to the present invention.

Referring to FIG. 1, a bag body 1 of a golf bag is formed so that it has an insert port 1*a* at an upper portion thereof, and a reception bottom at a lower portion thereof. An upper region of an inner surface 2 of the bag body 1 is provided with a guide member 4, which is adapted to guide a shaft 3*a* when a golf club 3 is drawn out of or inserted into the bag body 1, in such a manner that the guide member 4 extends to the middle in the direction of the depth (in the vertical direction) of the inner surface 2. The guide member 4 may be provided at least on the upper region of the inner surface 2. Therefore, the guide member 4 may be provided on the upper region alone of the inner surface 2, or on the whole of the inner surface 2 so that the guide member 4 reaches the reception bottom.

The guide member 4 which is to be provided at least on an upper region of the inner surface 2 may be fixed on a region L extending from the portion of the inner surface 2 which is in the vicinity of the insert port 1*a* of the bag body 1 to at least the middle in the lengthwise direction (in the direction of the depth) because, in this region L, a grip portion of the shaft 3*a* contacts the inner surface 2 of the bag body 1 forcibly when the golf club 3 is drawn out of and inserted into the bag body 1. In the region L, the guide member 4 may be provided over the whole circumference of the inner surface 2 or over a part thereof. In order to provide the guide member 4 so as to extend over a part of the circumference of the inner surface 2, it may be fixed on the inner surface of, for example, the side portion of the bag body which faces in the upward direction when the golf bag is placed on a golf cart.

The bag body 1 of the golf bag is provided at the portion thereof which is in the vicinity of the insert port 1*a* with at least one partition member 5 which separates an opening of the insert port 1*a* into a plurality of spaces, and which extends so as to cross the insert port 1*a*, for the purpose of inserting a golf club 3 easily into the bag body 1 of the golf bag 1. According to the present invention, guide members 4*a*, which are other than the guide members 4 on the inner surface 2, may also be provided on the lateral side surfaces of the partition members 5 in addition to the guide members 4 provided on the inner surface 2 of the bag body 1 as mentioned above. Owing to the guide members 4*a* thus provided, the shaft 3*a* is also guided by the guide members 4*a* on the lateral side surfaces of the partition members 5 when the golf club 3 is drawn out of and inserted into the bag body 1. This enables the golf club 3 to be drawn out of and inserted into the golf bag more smoothly.

According to the present invention, the guide member 4 preferably comprise a plurality of rows, which are arranged in parallel with one another in the vertical direction of the inner surface 2, of roller members 6 each comprising a plurality of small rollers 6*a* connected to one another so that the rollers can be rotated relatively to one another as shown in FIG. 1. The roller member 6 can be produced by providing holes in the central portions of a plurality of rollers 6*a* of, for example, a synthetic resin, and connecting the rollers 6*a* to one another by inserting a steel wire through these holes.

Figure 2:
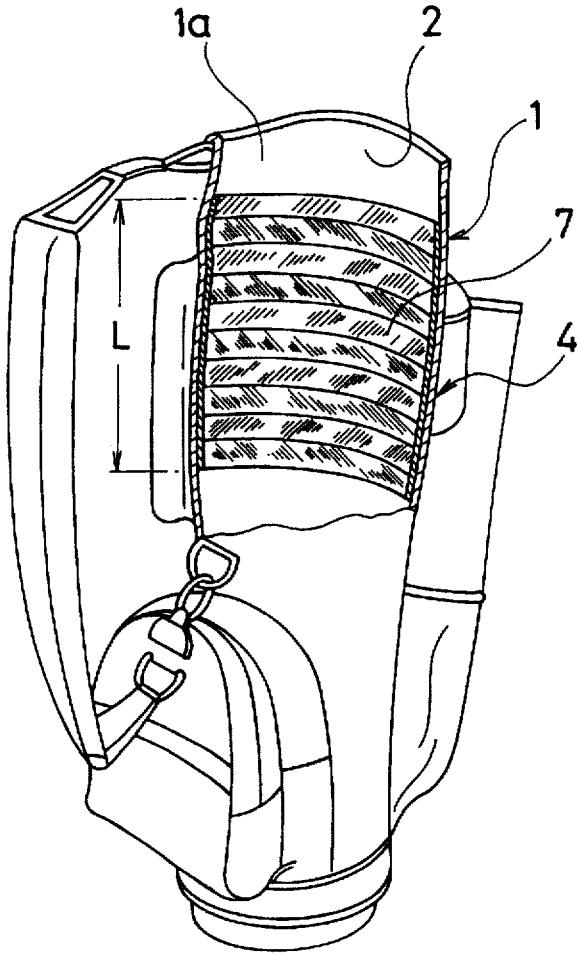
FIG. 2 is a partially cutaway view in perspective of another example of the golf bag according to the present invention.

FIG. 2 shows a golf bag provided with sheet type members of a low frictional resistance, which is formed out of a synthetic resin, such as polyethylene or polypropylene, as guide members 4. These low frictional resistance members 7 are provided in a plurality of parallel rows arranged in the vertical direction of the inner surface 2.

The guide members 4*a* may also be formed out of the same material as the guide members 4.

Since the bag body 1 of the golf bag according to the present invention is provided as mentioned above at least on an upper region of the inner surface 2 thereof with a member 4 for guiding the shaft 3*a* of the golf club 3, the drawing and inserting of the golf club 3 out of and into the bag body 1 can be done smoothly via the guide member 4. Therefore, the grip portion of the shaft 3*a* is not caught on the upper region of the inner surface 2 of the bag body 1 of the golf bag. This enables the breakage and deformation of the shaft, which are encountered in a conventional golf club, to be prevented. Since a bending force which causes the shaft to be deformed greatly and compressive stress are rarely exerted on the shaft, the durability of the golf club 3 can be improved.

What is claimed is:

1. In a golf bag including a golf bag body having an insert port in an upper portion thereof and longitudinally spaced therefrom a closed bottom in a lower portion thereof for receiving and holding a plurality of golf club shafts, the improvement comprising in an upper region of an inner surface of said golf bag body at least one row of a plurality of independently rotatable rollers extending generally transverse to the longitudinal direction of the golf bag body so that the shafts of said golf clubs are guided by said rollers as they are drawn out of and inserted into said golf bag body.

2. The golf bag of claim 1, including a plurality of transversely extending rows of rollers arranged parallel to one another on the inner surface of the bag body in a region that extends in the longitudinal direction from a point near the insert port to a point approximately midway between said insert port and the closed bottom of the golf bag body.

3. The golf bag body of claim 1, wherein said insert port is provided with at least one partition member extending across said insert port transverse to the longitudinal direction of the golf bag body.

* * * * *